US007147318B2

(12) United States Patent
Garofalo et al.

(10) Patent No.: US 7,147,318 B2
(45) Date of Patent: Dec. 12, 2006

(54) SWIMMING OR DIVING GOGGLES

(75) Inventors: Giovanni Garofalo, Rapallo (IT); Andrea Silvestri, Genoa (IT)

(73) Assignee: HTM Sport S.p.A. (IT)

( * ) Notice: Subject to any disclaimer, the term of this patent is extended or adjusted under 35 U.S.C. 154(b) by 432 days.

(21) Appl. No.: 10/674,406

(22) Filed: Oct. 1, 2003

(65) Prior Publication Data

US 2004/0064875 A1 Apr. 8, 2004

(30) Foreign Application Priority Data

Oct. 4, 2002 (IT) ..... GE2002A0092

(51) Int. Cl.
*G02C 7/02* (2006.01)

(52) U.S. Cl. ..... 351/41; 351/159

(58) Field of Classification Search ..... 351/41, 351/44, 159

See application file for complete search history.

(56) References Cited

U.S. PATENT DOCUMENTS 4,977,627 A 12/1990 Metcalfe et al.
5,581,822 A 12/1996 Tagyo
5,774,201 A * 6/1998 Tackles ..... 351/159
5,777,712 A 7/1998 Sansalone

FOREIGN PATENT DOCUMENTS

| | | |
|---|---|---|
| EP | 02 824 029 | 8/1997 |
| FR | 2 725 630 | 4/1996 |
| WO | WO 00/38789 | 7/2000 |

* cited by examiner

*Primary Examiner*—Huy Mai
(74) *Attorney, Agent, or Firm*—Stites & Harbison PLLC; Marvin Petry

(57) ABSTRACT

Swimming or diving goggles comprising a pair of lenses that are separate or carried out as one piece, and a sealing frame surrounding said lenses; each of said lenses is provided with a temporal portion and with a nasal portion; said nasal portion is bent on a substantially horizontal plane and follows a first theoretical cylindrical surface with substantially vertical generatrixes, whereas said temporal portion is bent on a second theoretical surface having a combined bend both on a horizontal and on a vertical plane.

6 Claims, 2 Drawing Sheets

SWIMMING OR DIVING GOGGLES

BACKGROUND OF THE INVENTION

The present invention relates to swimming or diving goggles.

As is known, swimming or diving goggles generally consist of two lenses that are separate or carried out as one piece, and usually comprise a sealing frame enabling a user, both a swimmer or a diver, to wear said goggles and prevents water from getting into contact with the user's eyes. Said lenses can be made of glass, plastic or other material and have a substantially plane, cylindrical, spheroidal or rounded shape.

Said known lenses have various drawbacks, among which bad visibility, limitation of visual field and inefficient hydrodynamic shape in case of plane lenses; problems involving image splitting in central areas of the visual field for cylindrical lenses with bend having constant radius; great visual problems and distorted images due to broad toroidal areas surrounding the central portion of the lenses if the latter have a substantially spherical or rounded shape.

From European Patent Application EP-A 0 824 029 swimming or diving goggles are known comprising a pair of eyepieces having a pair of lenses, separate or made as one piece, and contact means apt to be sealingly applied onto the face surface surrounding a user's eyes. Each of said lenses is shaped according to a theoretical cylindrical surface with vertical rectilinear generatrixes having a progressively variable bend radius, i.e. greater on a front lens portion and smaller on a side lens portion.

The solution suggested in the aforesaid patent application improves previous goggles since it reduces phenomena due to image splitting in the central area of said goggles and increases general visibility for the user.

Such goggles, however, have several drawbacks, among which an imperfect hydrodynamic shape, since the provided lenses follow a bend obtained exclusively on a horizontal plane with respect to the goggles when worn, thus giving rise to areas, above all in the side or temporal portion of said goggles, which do not perfectly fit the user's face, and the presence of a certain blurring in said temporal areas of the lenses, due to the strictly cylindrical shape of the lens in said areas, also with a smaller bend radius with respect to the front area.

SUMMARY OF THE INVENTION

The present invention, therefore, aims at overcoming the drawbacks of known swimming or diving goggles mentioned above by means of goggles ensuring an excellent adaptability to the user's face, a high hydrodynamic efficiency during use and having a highly improved visual field with respect to known goggles.

Said aim is achieved by the present invention through swimming or diving goggles comprising a pair of lenses that are separate or carried out as one piece, and a sealing frame surrounding said lenses; each of said lenses is provided with a temporal portion and with a nasal portion: said nasal portion is bent on a substantially horizontal plane and follows a first theoretical cylindrical surface with substantially vertical generatrixes, whereas said temporal portion is bent on a second theoretical surface having a combined bend both on a horizontal and on a vertical plane.

BRIEF DESCRIPTION OF THE DRAWINGS

Further aims, characteristics and advantages of the present invention will be evident from the following description of one of its embodiments, regarded as a mere non-limiting example with reference to the enclosed drawings, in which.

DESCRIPTION OF THE PREFERRED EMBODIMENT OF THE INVENTION

Figure 1:
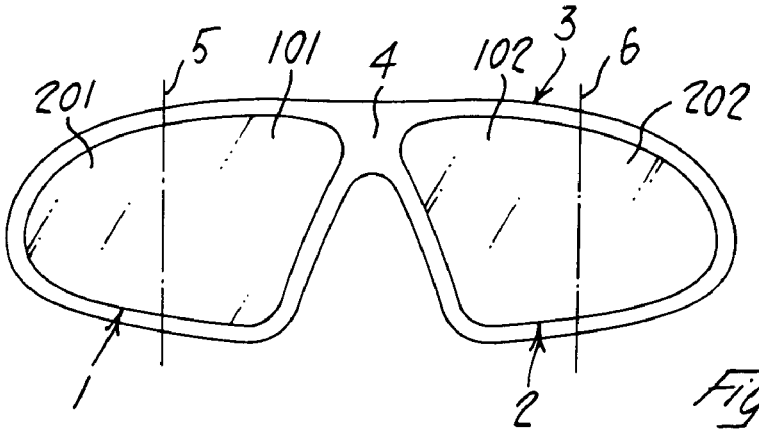
FIG. 1 shows a front view of an embodiment of a pair of swimming and diving goggles according to the present invention.

With reference to the enclosed drawings and in particular to FIG. 1, the numerals 1 and 2 refer to two lenses of a pair of swimming or diving goggles according to the present invention. Said lenses 1 and 2 are surrounded by a sealing frame 3 comprising a central separator 4 resting on a user's nose. Said lenses 1 and 2 are identical, perfectly symmetrical with respect to said separator 4 of frame 3 and comprise each a nasal portion 101 and 102 and a temporal portion 201 and 202, respectively. For each lens 1 and 2 said nasal portions 101 and 201 and said temporal portions 102 and 202 are ideally defined for convenience's sake by a vertical axis, i.e. axis 5 for lens 1 and axis 6 for lens 2. In the present embodiment there are two lenses 1 and 2, therefore physically separated through the separator 4 of frame 3, but obviously the present goggles could be provided with lenses carried out as one piece by connecting the nasal portions of the two lenses 1 and 2 by means of a central lens portion, placed where the current separator 4 is shown and provided below and above with sealing edges wholly similar to those of frame 3.

Figure 2:
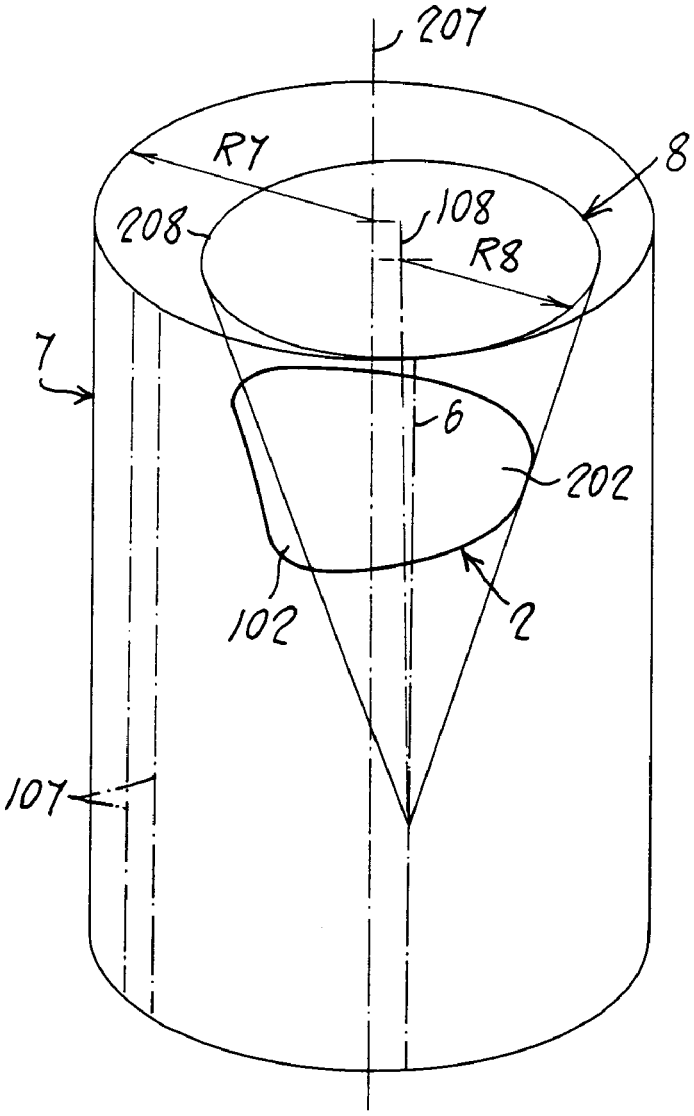
FIG. 2 is a schematic perspective view of a lens of the goggles in FIG. 1.
Figure 3:
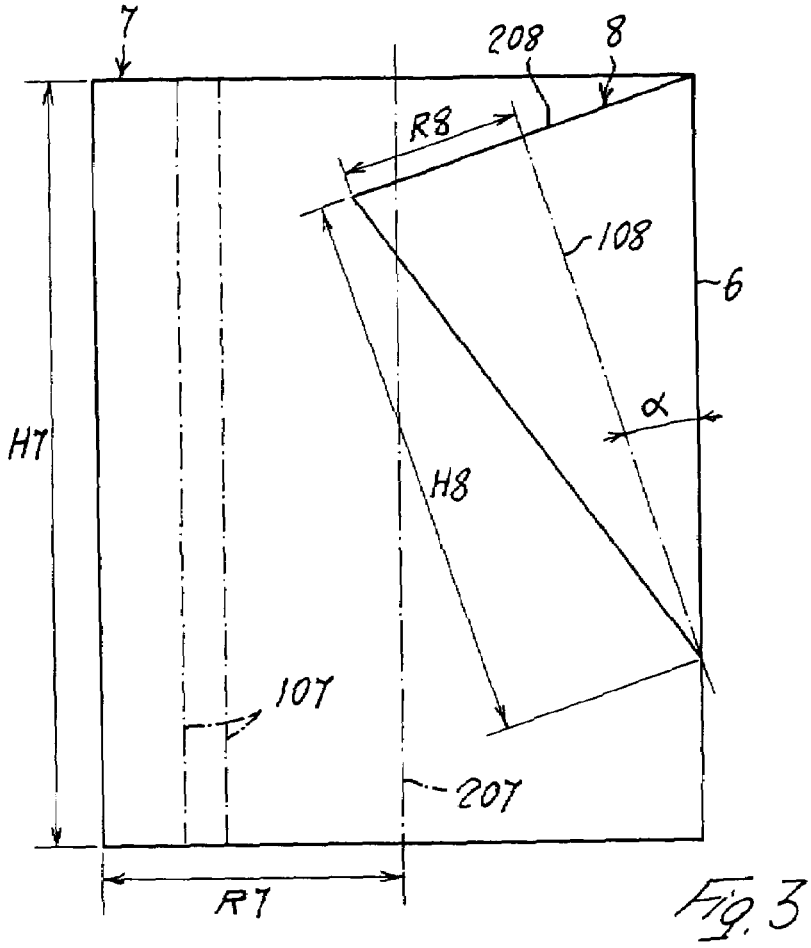
FIG. 3 shows a schematic side view of an upside-down conical surface and of a cylindrical surface, both defining the bend of the lens in FIG. 2.

The surfaces of said lenses 1 and 2 have on the temporal portions 102 and 202 a type of combined bend both on a horizontal and on a vertical plane with respect to the goggles in FIG. 1. Said bend is shown in FIG. 2 by way of example for lens 2, but what follows obviously applies in quite a similar way for lens 1. The nasal portion 102 of lens 2 has a profile contained within the vertical generatrixes 107 of a cylindrical surface 7 having a given radius R7 and a symmetry axis 207, therefore said nasal portion 102 has a bend only on a horizontal plane with respect to the goggles 1. Conversely, the temporal portion 202 of said lens 2 has a bend substantially contained within an upside-down conical surface 8 provided with a circular base 208 with a radius R8 and its own symmetry axis 108 inclined of a given angle $\alpha$, see FIG. 3, with respect to the vertical directrixes 107 of the cylindrical surface 7 and to the vertical axis 6. Said vertical axis 6, which defines the temporal 202 and nasal 102 portion of lens 2, represents the generatrix of the cylindrical surface 7 connecting with the conical surface 8. In this embodiment of the invention said upside-down conical surface 8 is contained within the cylindrical surface 7, therefore its radius R8 is smaller than radius R7 of cylinder 7 and its height H8 is smaller than height H7 of the cylindrical surface 7, but is could also be provided that the temporal portion 202 follows a profile substantially defined by the conical surface 8 having a radius R8 that is identical or greater with respect to radius R7 of the cylindrical surface 7, and/or a height H8 that is identical or greater with respect to height H7 of the cylindrical surface 7.

In short, on the basis of these numberless combinations of radius R8 and height R8 of the conical surface 8 with respect to radius R7 and height H7 of the cylindrical surface 7 it is possible to define endless profiles for the temporal portion 202 of lens 2. For instance, given a cylinder having a given height H7, a given radius R7 and given a cone having a given radius R8 and a given height H8, height H8 of said cone is in inverse proportion to the angle α of inclination of axis 108 with respect to the vertical axis 6 (which also defines one of the directrixes of the cylinder): therefore, the greater height H8 is, the smaller the angle α of inclination between axis 108 and the vertical axis 6 will be, then the smaller the twist of lens 2 on its temporal portion 202 will be. Conversely, if height H8 is kept constant and radius R8 of the cone is changed, said radius R8 is in direct proportion to angle α, therefore the greater said radius R8 is, the greater the twisting angle α of said temporal portion 202 of said lens 2 will be.

Figure 4:
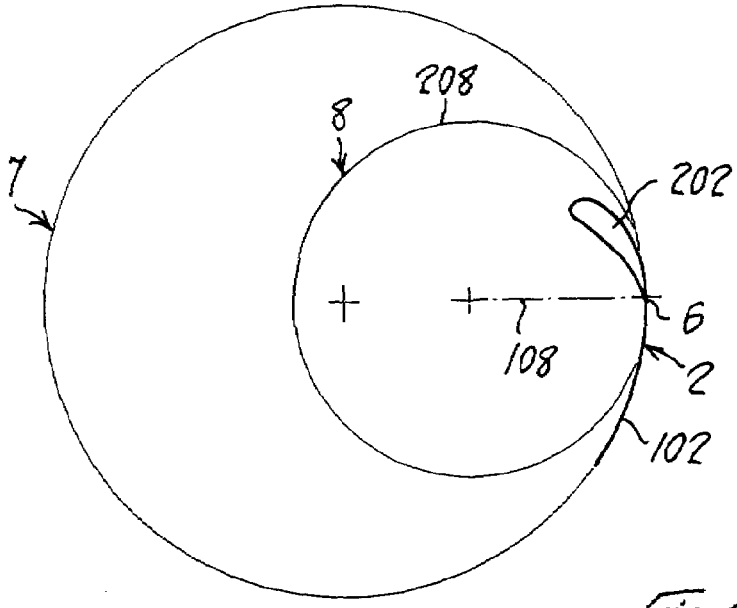
FIG. 4 shows a schematic top view of the lens in FIG. 2.

The lens 2 thus obtained, by varying the bend of the temporal portion 202 both on a vertical and on a horizontal plane with respect to the goggles when worn, can be seen also in FIG. 4, where its twist with respect to known cylindrical lenses, i.e. the development of the nasal portion 102 on a cylindrical surface 7 and the development of the temporal portion 202 on an upside-down conical surface 8, can be better observed.

We claim:

1. Swimming or diving goggles comprising a pair of lenses that are separate or carried out as one piece, and a sealing frame surrounding said lenses, each of said lenses being provided with a temporal portion and with a nasal portion, wherein said nasal portion is bent on a substantially horizontal plane and follows a first theoretical cylindrical surface with substantially vertical generatrixes, whereas said temporal portion is bent on a second theoretical surface having a combined bend both on a horizontal and on a vertical plane.

2. Goggles according to claim 1, in which said second theoretical surface is a substantially conical surface having at least an area connecting with said cylindrical surface.

3. Goggles according to claim 2, in which said connecting area is represented by at least one of the generatrixes of the cylindrical surface.

4. Goggles according to claim 2, in which said conical surface is turned upside down and is provided with a symmetry axis inclined of a given angle (α) with respect to the symmetry axis of the cylindrical surface.

5. Goggles according to claim 2, in which said conical surface comprises a circular base with a constant radius.

6. Goggles according to claim 1, in which said cylindrical surface is provided with a constant bend radius.

* * * * *